US005884560A

United States Patent [19]

Opitz et al.

[11] Patent Number: 5,884,560

[45] Date of Patent: Mar. 23, 1999

[54] PRINTING FORM FOR A ROTARY RELIEF-PRINTING METHOD

[75] Inventors: Joachim Opitz; Ralf Raue; Jürgen Reck, all of Aachen; Christoph Hars, Reinheim; Joachim Sonnenschein, Mühltal, all of Germany

[73] Assignee: U.S. Philips Corporation, New York, N.Y.

[21] Appl. No.: 947,672

[22] Filed: Oct. 9, 1997

[30] Foreign Application Priority Data

Oct. 16, 1996 [DE] Germany ..... 196 42 634.0

[51] Int. Cl.[6] ..... B41N 1/12

[52] U.S. Cl. ..... 101/401; 101/395

[58] Field of Search ..... 101/395, 397, 101/399, 401, 401.1, 401.3; 430/306

[56] References Cited

U.S. PATENT DOCUMENTS

| | | | |
|---|---|---|---|
| 3,891,443 | 6/1975 | Halpern et al. | 101/395 |
| 4,152,986 | 5/1979 | Dadowski et al. | 101/395 |
| 4,283,484 | 8/1981 | Fairhead | 101/395 |
| 5,435,247 | 7/1995 | Giori et al. | 101/401 |
| 5,544,582 | 8/1996 | Bocko et al. | 101/211 |

FOREIGN PATENT DOCUMENTS

| | | |
|---|---|---|
| 635378 | 1/1995 | European Pat. Off. . |
| 4324577C1 | 12/1994 | Germany . |
| 94696 | 8/1991 | Switzerland . |
| 2241352 | 8/1991 | United Kingdom . |

*Primary Examiner*—Stephen R. Funk
*Attorney, Agent, or Firm*—F. Brice Faller

[57] ABSTRACT

The invention relates to a printing form for a rotary relief-printing method, in which the printing dots transferring the printing ink constitute a half-tone screen and are superimposed by a relief structure constituted by indentations. Such printing forms are used, for example in flexographic printing methods for printing glass plates, for example display screens having a luminescent material coating. In the manufacture of these screens, the printing ink must be applied homogeneously and the ink dots appearing in the printed image must have a uniform border area. According to the invention, the printing form is to this end implemented in such a way that the relief structures are arranged homogeneously relative to the printing dots and, if the printing dots are periodically spread across the printing form, these relief structures are superimposed on the printing dots preferably with the same period. Moreover, the relief structures are arranged in such a way that the indentations do not intersect the border area of a printing dot.

10 Claims, 4 Drawing Sheets

PRINTING FORM FOR A ROTARY RELIEF-PRINTING METHOD

BACKGROUND OF THE INVENTION

The invention relates to a printing form for a rotary relief-printing method, in which the printing dots transferring the printing ink constitute a half-tone screen and are superimposed by a relief structure constituted by indentations.

In the rotary relief-printing method, the ink is transferred onto the print directly by means of the printing form. This form is manufactured as a printing plate and clamped onto the jacket of a printing block cylinder. When a printing motif or a printing image is being printed, it is formed as a generally regular printing screen so as to generate so-called half-tones, whose raised printing dots constitute plane printing surfaces which are inked by means of a suitable device and transfer the ink onto the material to be printed.

A printing form of the type described in the opening paragraph is known from DE-C1-43 24 577. The fine screen, which in this printing form is constituted as a relief structure in the form of indentations and is superimposed on the half-tone screen, allows a homogeneous and adequate transfer of ink onto a non-absorptive material, for example glass. Both the half-tone screen and also the fine screen are unambiguously defined by way of the so-called screen number, i.e. the number of printing lines or printing dots per centimeter, calculated in the direction of the shortest distance and the percentage of surface coverage. Since the individual printing surfaces or printing dots are arranged in lines, it is common practice to speak of lines per centimeter. The screen number thus represents the division or dot spacing. The dot size is determined by the percentage of surface coverage. The percentage of surface coverage is the ratio between the surfaces of the raised printing dots and the total surface of the mosaic printing motif. The printing dots do not need to be circular but may fundamentally have any arbitrary geometrical shape.

In the known printing form, the outer boundary of the printing dots of the half-tone screen may be interrupted by the structure of the fine screen so that a well-defined boundary of the printing dots is no longer guaranteed. This is caused by the fact that only the screen number and the percentage of surface coverage is taken into account when selecting the fine screen. However, the areas in which the fine screen is superimposed on the half-tone screen are not taken into account. Consequently, fine screen dots (indentations) may be only partially superimposed on the printing dots in their border areas so that the border area of such a printing dot is interrupted. This effect is particularly essential in those cases in which only a small number of fine screen dots having a relatively large surface is allocated to a printing dot of the half-tone screen. As a result, an irregular boundary, or serrated edges, can clearly be recognized in the printed image of such printing dots. This has a negative effect, particularly when manufacturing flat-panel display screens, in which the flexographic printing method may be used for providing the glass plate with a luminescent material coating.

OBJECTS AND SUMMERY OF THE INVENTION

It is therefore an object of the invention to provide a printing form of the type described in the opening paragraph with which an improved printed image can be obtained.

According to the invention, the relief structures are arranged homogeneously relative to the printing dots and are superimposed on the printing dots in such a way that no indentations are present at the border areas of the printing dots.

The invention is based on the recognition that the position and size of the printing dots constituting the half-tone screen should be taken into account when selecting a relief structure. The relief structure should be arranged homogeneously relative to the printing dots, i.e. each relief structure should have the same position relative to the printing dot on which it is superimposed. Moreover, the relief structure superimposed on a printing dot should not extend as far as the border area of the printing dot so that the border area is not interrupted there, which would have the result that the ink taken up by the indentations prior to the printing operation could flow away at these areas during this operation. This would lead to said irregular boundary of the printed image of a printing dot. The relief structures are thus arranged in such a way that the border area of a printing dot is not intersected by an indentation.

In an embodiment of the invention, the printing dots are arranged periodically, and the relief structures are arranged periodically with the same period or a multiple of this period. This means that the relief structure superimposed on a printing dot is spaced apart from the relief structures superimposed on the neighboring printing dots by the same distance as the printing dots themselves. If the period of the relief structures corresponds to a multiple of the period of the printing dots, then this means that some printing dots are not superimposed by a relief structure and thus have no indentations.

In a preferred further embodiment of the invention, the relief structure is constituted by at least one annular indentation per printing dot. The annular indentations are preferably arranged concentrically with respect to the center of the printing dot and the indentations do not intersect each other when there are more of such indentations per printing dot. A relief structure implemented in this way has the advantage that the ink taken up by the indentation evenly flows into all directions on the printing surface of the dot during the printing process and that the ink is uniformly transferred. Alternatively, a plurality of annular indentations preferably arranged concentrically with respect to the center of the printing dots may be provided for each printing dot. However, for reasons of a maximal volume of the circular indentations, there is an upper limit to this number of annular indentations because the edges of the indentations should not be arbitrarily steep for reasons of stability. Moreover, the width of the indentations is also limited by the pigment size of the ink particles because the indentations should not be so narrow that ink particles may get clogged in these indentations.

An alternative embodiment of the invention is characterized in that the relief structure is constituted by an indentation situated in the center of the printing dot. Also with such a relief structure, the ink is transferred uniformly without irregular boundaries, or serrated edges, of the printing dots appearing in the print.

Circular and hexagonal printing dots have particularly proved to be advantageous in the application of luminescent material coatings on the glass plates of display screens. However, to solve this object, it is possible to use different implementations of printing dots on which a relief structure of the type described is superimposed in accordance with the invention, which relief structure consists of regular, self-contained indentations which are arranged in a spaced relationship and do not intersect each other or the edges of the individual dots, but are preferably arranged parallel to the boundaries of the individual printing dots.

The printing form and printing machines employed with such a printing form in accordance with the invention are used in the rotary relief-printing methods, inter alia, the flexographic printing method. Such printing methods may also be used for printing hard, non-absorptive materials, particularly glass. The flexographic printing method is particularly suitable for printing glass plates of display screens having a luminescent material coating. Particularly flat-panel display screens for color display tubes can be advantageously manufactured in accordance with the invention by means of a flexographic printing machine which is suitable for printing flat materials which, when bent, are easily breakable (low bending stress).

The flexographic printing method may be further used for providing, for example black matrices, color filters, conductor tracks, resistive coatings, barrier and spacing structures on display screen surfaces.

These and other aspects of the invention are apparent from and will be elucidated with reference to the embodiments described hereinafter.

DESCRIPTION OF THE PREFERRED EMBODIMENTS

Figure 1:
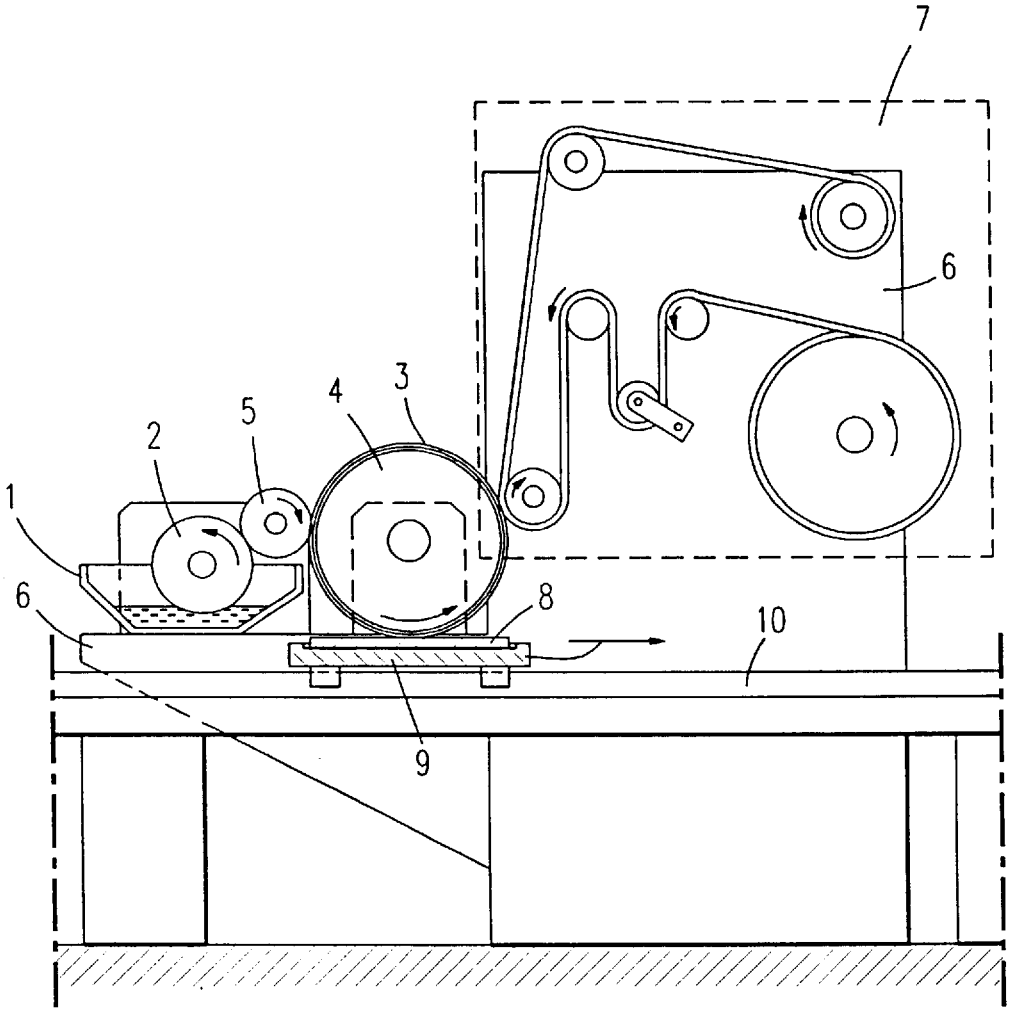
FIG 1. shows diagrammatically a special flexographic printing machine suitable for printing flat, low-bending stress material.

FIG. 1 shows diagrammatically a flexographic printing machine which is suitable for printing, for example glass plates of flat-panel display screens. The actual printing device comprises an ink trough 1, a take-up roll 2 dipped into the ink, a block cylinder 4 provided with the printing form or the block 3, and a mosaic ink-feed roll 5 which transfers the ink from the take-up roll 2 to the printing form 3. The take-up roll 2, the block cylinder 4 and the mosaic ink-feed roll 5 are journaled on a machine frame 6 in the conventional manner and synchronously driven by means of a drive system (not shown) so that their peripheral velocities are mutually equal.

Behind the block cylinder 4, a device 7, with which the ink residues adhering to the printing form 3 after the printing process are removed from the printing form 3, is arranged on the machine frame 6. Likewise as the carrier system with a slide 9 which is movable on rails 10 and on which the glass plate 8 is positioned and retained in an accurately defined manner, this device 7 is not described in this application. For this purpose, reference is made to the aforementioned patent DE-C1-43 24 577.

Figure 2:
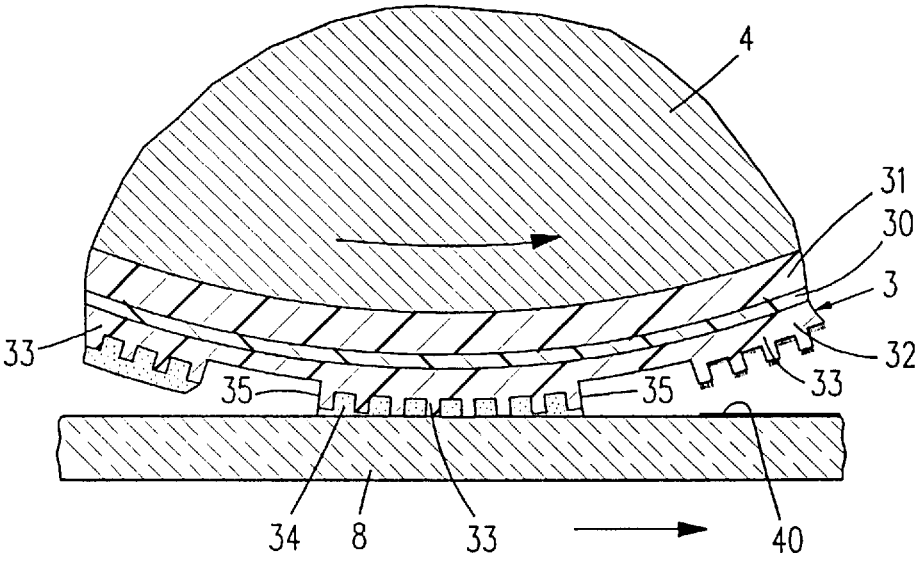
FIG. 2 shows a part of a printing form for a flexographic printing machine as shown in FIG. 1.

FIG. 2 shows diagrammatically on a much larger scale how the ink is transferred onto the glass plate 8 when a printing form 3 is used. The printing form 3, which is provided on the block cylinder 4, consists in known manner of a stabilizing foil 30 and a photopolymer coating 32 with the printing dots 33 which are arranged periodically in a half-tone screen constituting the printing motif. To compensate for possible unevennesses of the systems used for transferring the ink onto the material to be printed, the printing form 3 is provided in a known and preferred manner on the block cylinder 4 via an elastic foam adhesive foil 31. FIG. 2 shows three printing dots 33. Superimposed on the printing dots 33 is a relief structure which, in this case, is constituted by indentations 34 and extends as far as the border area 35 of the printing dots 33. The ink, which is held on the surface of the printing dots 33, is transferred onto the glass plate 8 during the rolling process, so that ink-covered surfaces 40 are obtained on the upper side of the glass plate 8.

Figure 3:
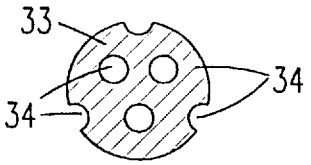
FIG. 3 is a plan view of a printing dot of a mosaic printing form in accordance with the prior art.

A prior art printing dot 33 of a printing form shown in FIG. 2 is shown in a plan view in FIG. 3. The Figure shows that the relief structure, which, in this case, is constituted by indentations 34, is superimposed on the printing dots in such a way that indentations 34 are also situated in the border areas. The outer boundary of the printing dot 33 is thus interrupted by the relief structure, so that a well-defined boundary of the printing dot 33 is no longer guaranteed. This effect, which is particularly essential in those cases in which only a small number of indentations 34 of the relief structure is allocated to a printing dot 33, may occur in the aforedescribed photolithographic process for manufacturing the printing form 3. It is caused by the fact that, in the manufacture of the half-tone screen and the relief structure, two films are laid on top of each other and simultaneously exposed, one film (the half-tone screen film) carrying the half-tone screen and the other film (the relief structure film) carrying the screen for the relief structure. However, only the desired screen number (number of lines per cm) and the desired surface coverage are then taken into account. The fact where and in which way the two screens are superimposed on each other is not taken into account.

This has the result that the ink-covered surfaces on the glass plate have irregular outer boundaries, or serrated edges, and that there is no uniform transfer of ink throughout the printing dot. For example, when the prior art printing dots 33 shown in FIG. 3 are used, an exactly round ink spot 40 is not obtained, while at the areas where indentations 34 are present at the outer edge of the printing dot 33, the ink may very easily run out when it is being transferred, so that deviations from the round shape may result at these areas.

Figure 4:
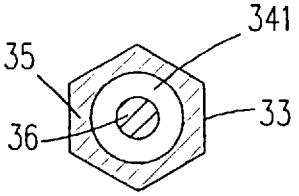
FIG. 4 is a plan view of a printing dot of a mosaic printing form in accordance with the invention.
Figure 5:
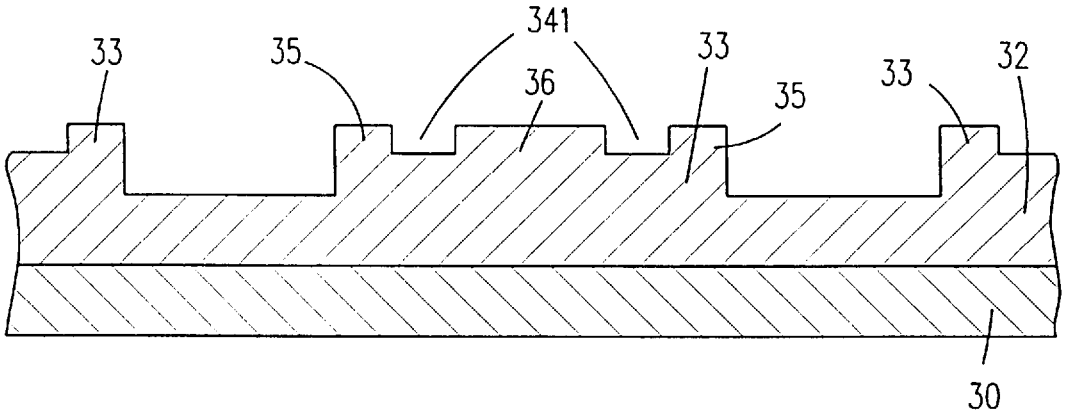
FIG. 5 is an elevational view of a section of a printing form with a printing dot as shown in FIG. 4.

A printing dot 33 for a printing form in accordance with the invention, with an annular indentation 341 around the center of the printing dot 33 is shown in a plan view in FIG. 4. The printing dot 33 has a hexagonal shape in this case. A section of a printing form with such printing dots is shown in an elevational view in FIG. 5.

In the dimensioning of the annular indentation 341, it is important that it does not extend as far as the border area 35 of a printing dot 33. This would lead to the aforementioned drawbacks, namely no regular and defined boundaries of the ink-covered surface on the glass plate can be obtained. Moreover, an adequate stability of the printing dot should be ensured so as to avoid unwanted crushing of the printing dot. This stability is achieved in that the raised parts of the printing dot 33, i.e. the border areas 35 and the central area 36 are not too thin. The width and depth of the annular indentation 341 should be adapted to the pigment size of the ink used so as to ensure adequate filling and draining of the printing ink. In a hexagonal printing dot 33 with an annular indentation 341, as shown in the Figure, an efficient dimensioning has proved to be such that the radius of the raised central area 36, the width of the annular indentation 341 and the narrowest part of the outer border area are dimensioned to be approximately equally large. The width of the annular indentation should not fall below about the sixfold value of the average pigment size of the ink used. In a practical application of such a printing form for printing glass plates for flat-panel display screens, luminescent material suspensions are used in which the luminescent material particles have an average diameter of approximately 4.6 $\mu$m. Since the luminescent material suspension of course also comprises luminescent material particles of a larger diameter, the annular indentation 341 is 40 $\mu$m wide and 50 $\mu$m deep in one embodiment. The central area then has a diameter of 80 $\mu$m, and the printing dot 33 has a largest diameter of 300 $\mu$m.

When ink having a low viscosity is used, an ink spot having an approximately uniform circular shape is formed in spite of the hexagonal shape of the printing dot 33. At higher viscosities of the ink, however, the hexagon is formed, which may also be desirable in many applications.

Figure 6:
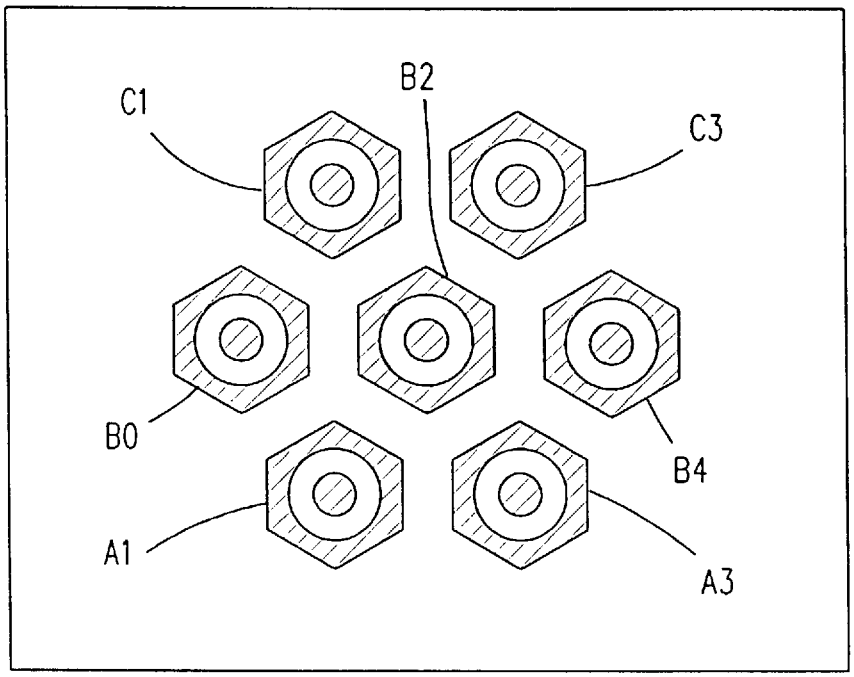
FIG. 6 is a plan view of the arrangement of a plurality of printing dots as shown in FIG. 4.
Figure 7:
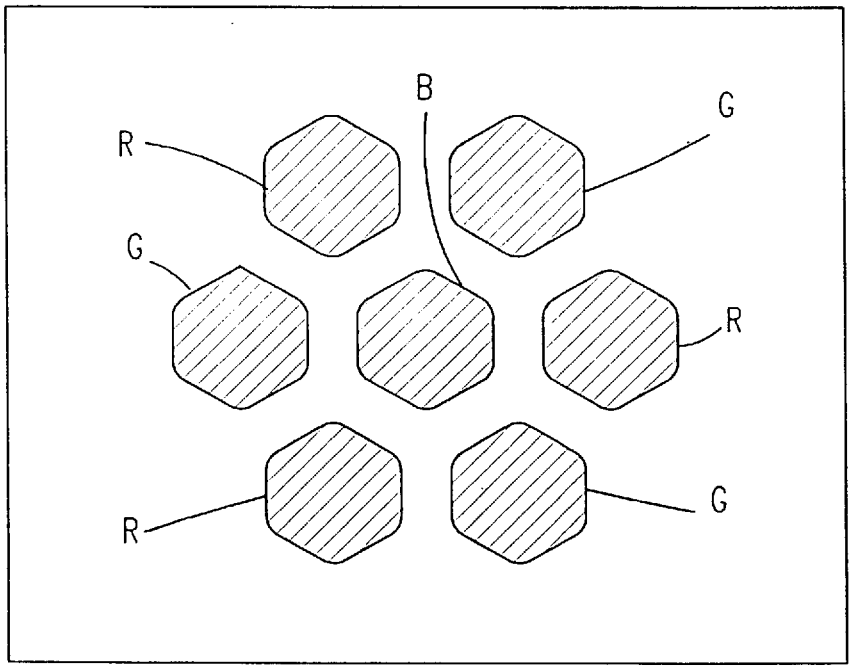
FIG. 7 is a printing motif obtained with the printing dots shown in FIG. 6.

FIG. 6 shows, in a plan view, the arrangement of a plurality of printing dots on a printing form 3 as shown in FIG. 4. A printing motif which can be obtained with these dots is shown in FIG. 7. It can be seen from, for example the second horizontal row that the printing dots are arranged linearly and are equally spaced apart in a row, i.e. they are arranged periodically on the printing form. The printing dots in two neighboring rows (for example A1, A3 and B0, B2, B4) are offset with respect to each other in the example shown. The printing dots are spread across the entire printing form in the manner shown.

According to the invention, the relief structure, i.e. the annular indentations in this case, is superimposed on the printing dots with the same period, such that no indentations are arranged at the border areas of the printing dots. In the example shown, it can be recognized that all annular indentations are arranged possibly centrally on the printing dot only and do not interrupt its border area. This can be achieved by spacing the screen dots for the relief structure apart by the same distance (the same period) on the relief structure film as the screen dots on the half-tone screen film for the printing dots.

The advantage of the hexagonal printing dots becomes manifest for flat-panel display screens. By means of the printing dots of the printing form according to the invention, ink is to be applied to the material to be printed, which is generally glass, whose color pigments fluoresce when appropriately illuminated. To be able to generate possibly bright images, the part of the surface of a flat-panel display screen inked with fluorescent color pigments should be as large as possible and the switching connections required for connecting and disconnecting the individual printing dots should be as small and narrow as possible. Hexagonal printing dots yield separating lands of a uniform width and thus a maximal surface coverage with luminescent or translucent dots.

Three printing forms of this type must be used for printing glass plates of color display screens. The first printing form has printing dots only at the areas A1, B4, C1 transferring the first luminescent material suspension, for example the red ink and yielding the red color spots R. A second printing form then has printing dots only at the areas A3, B0, C3, generating the green color spots G, while a third printing form has printing dots at the area B2, generating a blue color spot B.

Figure 8:
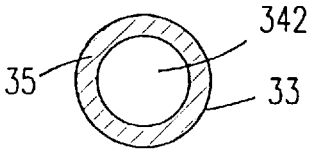
FIG. 8 is a plan view of a further implementation of a printing dot of a printing form in accordance with the invention.
Figure 9:
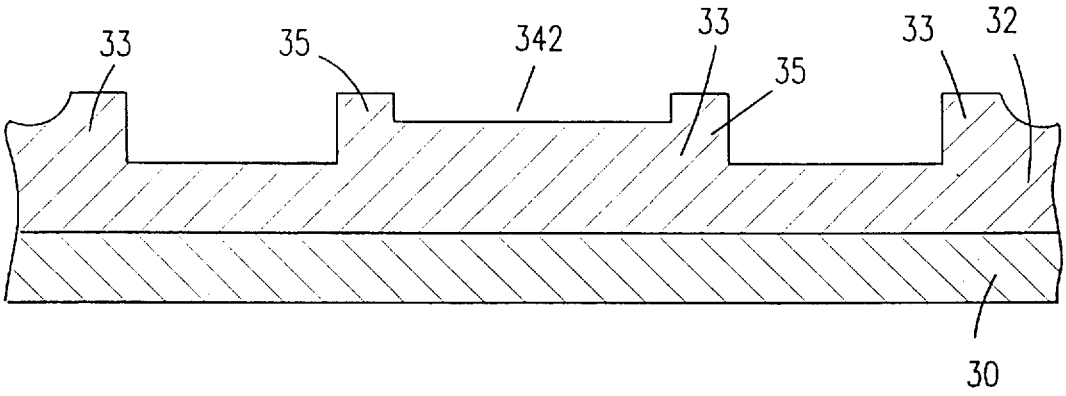
FIG. 9 is an elevational view of a section of a printing form with printing dots as shown in FIG. 8.

FIG. 8 shows a further embodiment of a printing dot 33 in a plan view and FIG. 9 shows this embodiment in an elevational view. In this case, the printing dot 33 has a central area 342 which is indented with respect to the border area 35. Before printing, a very large quantity of ink may collect in this area, which is then transferred onto the glass plate during the printing process. The indentation 342 is arranged in such a way and has such a size that the border area 35 is not interrupted by this indentation so that said drawbacks are also avoided with such a printing form.

According to the invention, many different implementations of relief structures which may be superimposed on the printing dots are feasible, for example, triangular, rectangular or linear indentations. Alternatively, a plurality of annular indentations may be arranged on one printing dot. The relief structure may not only be constituted by indentations but also by elevations with respect to the printing dot, while said requirements imposed on the stability of the printing dots and the dimensioning for preventing luminescent material particles from getting clogged should always be taken into account. The exterior shape of the printing dots may alternatively differ from the circular or hexagonal shape, for example a square shape, or a polygonal shape with more than six angles.

The printing form in accordance with the invention is manufactured in known manner via a photochemical process as described in DE-C1-43 24 577. When two films are used, one for the half-tone screen and the other for the relief structure, special care should be taken that the negative films are manufactured with great accuracy and that the negative film (relief structure film) with the screen of the relief structure is superimposed in the accurate position on the negative film with the half-tone screen for illuminating the printing form.

The manufacture of a printing form according to the invention is preferably realized by means of only one film comprising both the negative for the half-tone screen and, superimposed, the negative for the relief structure. Such a negative film then corresponds to the negative of FIG. 6: the bright parts in this Figure would be black in the negative film and the dark parts in FIG. 6 would be transparent, i.e. bright in the negative film.

We claim:

1. Printing apparatus comprising a printing form for a rotary relief printing method, said printing form comprising a plurality of printing dots constituting a half-tone screen for transferring printing ink, each dot having a hexagonal profile defined by border areas, and a plurality of indentations superimposed on respective printing dots, said indentations being arranged homogeneously relative to the printing dots and not being present at the border areas.

2. Printing apparatus as in claim 1 wherein said printing dots are arranged in rows and are uniformly spaced apart in each said row.

3. Printing apparatus as in claim 1 wherein each said indentation has an annular profile.

4. Printing apparatus as in claim 1 wherein each said indentation is centered within a respective said border area.

5. Printing apparatus as in claim 1 wherein there is only one said indentation in each printing dot.

6. Printing apparatus as in claim 1 comprising a flexographic printing machine of which said printing form is a part.

7. Method of printing a hard, non-absorptive material, said method comprising providing a rotary relief printing machine with a printing form comprising a plurality of dots constituting a half-tone screen for transferring printing ink, each dot having a hexagonal profile defined by border areas, said dots having superimposed thereon indentations arranged homogeneously relative to the printing dots and not being present at the border areas, providing a hard, non-absorptive material, and printing said hard non-absorptive material using said printing machine.

8. Method as in claim 7 wherein said hard, non-absorptive material is a glass plate.

9. Method as in claim 8 wherein said glass plate is printed with a luminescent material to form a flat panel display screen.

10. Method as in claim 7 wherein said printing machine is a flexographic printing machine.

* * * * *